United States Patent [19]

Wu

[11] Patent Number: 4,667,710

[45] Date of Patent: May 26, 1987

[54] LIQUID POURING DEVICE

[76] Inventor: Ta-Hsiung Wu, 23, Hsin I South Rd., Tainan City, Taiwan

[21] Appl. No.: 896,379

[22] Filed: Aug. 14, 1986

[51] Int. Cl.[4] ..... B65B 3/06

[52] U.S. Cl. ..... 141/198; 141/292

[58] Field of Search ..... 141/1, 40, 54, 198, 141/206, 275, 286, 292, 293, 294

[56] References Cited

U.S. PATENT DOCUMENTS

| | | | |
|---|---|---|---|
| 658,210 | 9/1900 | Ford | 141/54 X |
| 1,736,598 | 11/1929 | Hyatt | 141/292 |
| 3,334,668 | 8/1967 | Allen | 141/292 |
| 3,540,402 | 11/1970 | Kocher | 141/292 X |
| 3,606,096 | 9/1971 | Campbell | 141/292 X |
| 3,756,290 | 9/1973 | Cleland et al. | 141/275 X |
| 4,079,761 | 3/1978 | Herbst, Sr. | 141/292 X |
| 4,620,576 | 11/1986 | Owen, Jr. | 141/1 |

*Primary Examiner*—Stephen Marcus

*Assistant Examiner*—Mark Thronson

*Attorney, Agent, or Firm*—Armstrong, Nikaido, Marmelstein & Kubovcik

[57] ABSTRACT

A liquid pouring device comprises a conduit, a screwed cap, a partition plate, a tension spring, a valve collar and a funnel. The partition plate inserted in the conduit divides the conduit into one long channel and one short channel for the liquid and air to flow. The screwed cap with a gasket is fixed to the top end of the conduit for screwing on the container from which the liquid is to be poured. The stopper is fixed to the lower end of the partition plate and the valve collar is slidably fitted over the small part of the conduit. The tension spring is fitted over the conduit between the valve collar and the flange of the conduit. The funnel is connected with the valve collar. Thus, the liquid can be poured from the liquid container into an empty container smoothly and safely.

1 Claim, 4 Drawing Figures

LIQUID POURING DEVICE

BACKGROUND AND SUMMARY OF THE INVENTION

Usually, funnels are used for pouring liquids into empty containers. It is convenient but there are disadvantages. For example, attention must be concentrated on the pouring or spills or splashes would stain the clothes of the user. And hazards would occur if the liquid is a dangerous substance. To eliminate these disadvantages, the inventor developed a liquid pouring device which can be used for pouring liquids into empty containers smoothly and safely.

So the main object of this invention is to provide a liquid pouring device which can be easily connected to a liquid container and inserted in an empty container for fast pouring as the liquid container is depressed slightly.

Another object of this invention is to provide a liquid pouring device which is enclosed and free from spill and splash.

Still another object of this invention is to provide a liquid pouring device which can be used for pouring hazardous liquids to protect the operator from injury.

Yet another object of this invention is to provide a liquid pouring device with a tapering funnel (from $\phi$ 1.2 cm to $\phi$ 6.0 cm) to fit the container opening of different calibers.

DETAILED DESCRIPTION

Figure 1:
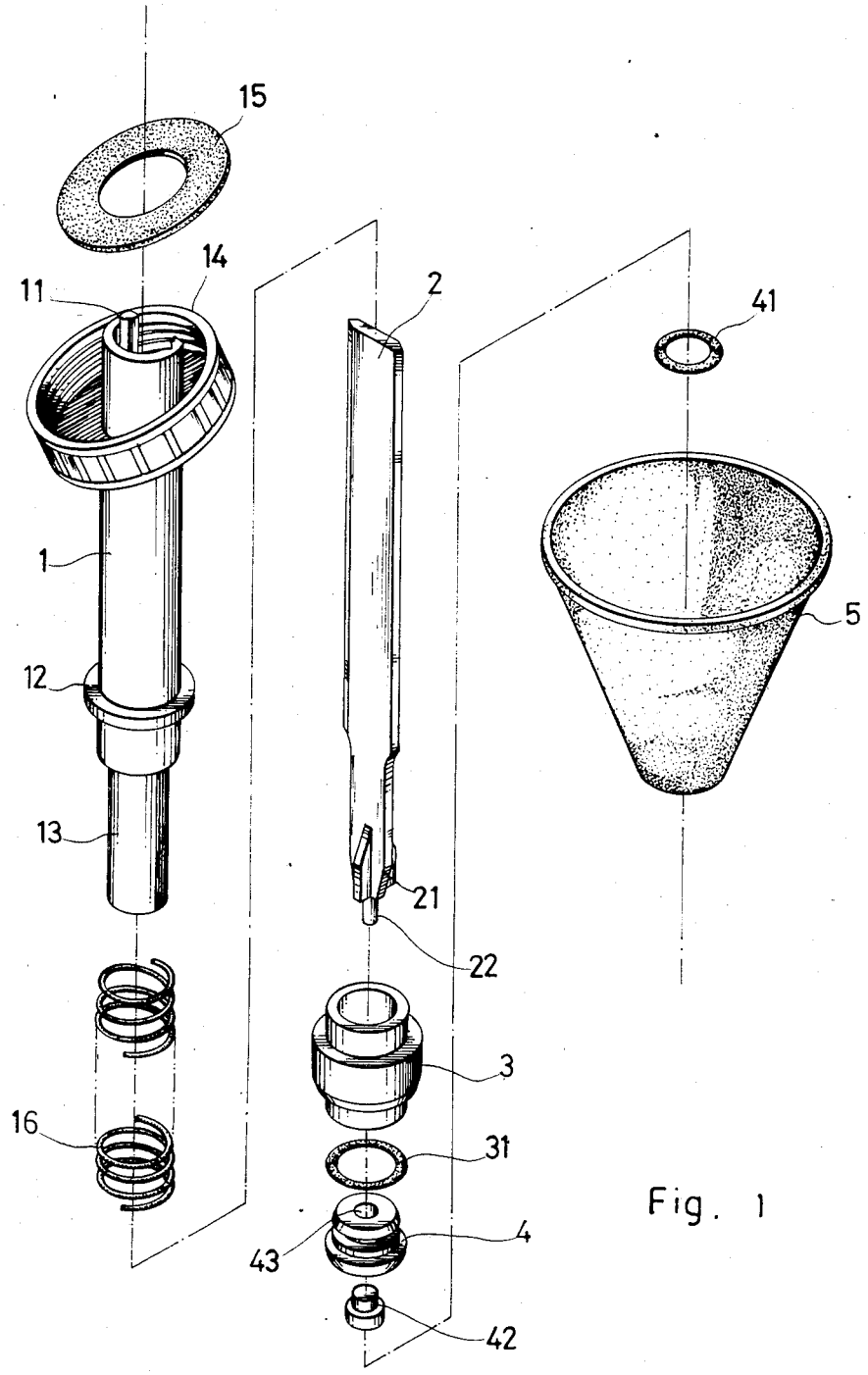
FIG. 1 is an exploded view of the liquid pouring device of this invention.

As shown in FIG. 1, the liquid pouring device of this invention mainly comprises a conduit 1, a screwed cap 14, a partition plate 2, a valve collar 3, a gasket 4 and a funnel 5. The conduit 1 has two symmetric retaining grooves 11 inside, a flange 12 at the waist, a small part 13 at the lower end, and a screwed cap 14 diagonally welded to the top end. A gasket 15 is fitted in the screwed cap 14. The conduit 1 has two openings, one higher and the other lower. The partition plate 2 inserted in the conduit 1 from the opening divides the conduit into one long channel 18 and one short channel 17. The partition plate 2 has a cruciate part 21 at the lower end. The cruciate part 21 fitted in the small part 13 of the conduit 1 has a connection 22 inserted in the riveting hole 43 of the stopper 4 and fixed by riveting with a cup head rivet 42 in the lower end of the riveting hole 43. Thus, the stopper 4 is fixed on the lower end of the cruciate part 21 of the partition plate 2 and an opening is formed between the lower end of the small part 13 of the conduit 1 and the stopper 4 for the liquid to flow. To start or stop the flow of liquid in the opening, a valve collar 3 is provided on the small part 13 of the conduit 1 and to make the valve collar 3 keep on stopping the flow of liquid in the opening, a tension spring 16 is fitted over the conduit 1 between the flange 12 and the valve collar 3. Besides, a funnel 5 consisting of a tapering tube is provided on the valve collar 3 for pouring liquids into containers that have openings of different calibers.

Figure 2:
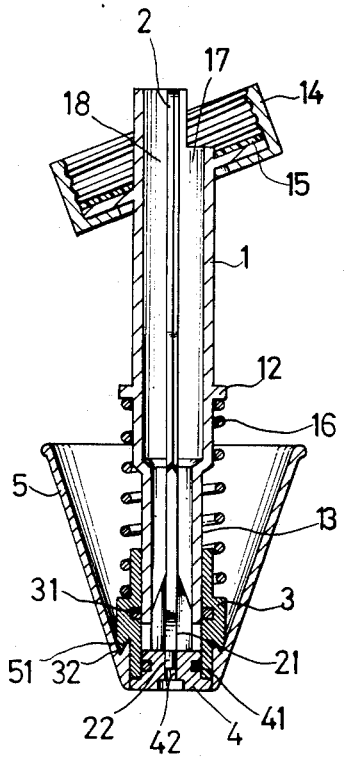
FIG. 2 is a longitudinal section of the said device.
Figure 3:
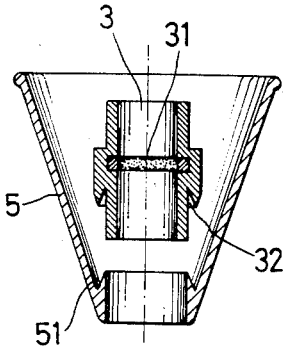
FIG. 3 is a longitudinal section of the funnel and valve collar of the said device.

As shown in FIGS. 2 and 3, the conduit 1 is divided by the partition plate 2 into a long channel 18 and a short channel 17 and has a screwed cap 14 fixed to the top end just below the opening of the short channel 17. Pushed by the tension spring 16, the valve collar keeps on stopping the flow of liquid in the opening between the small part 13 of the conduit 1 and the stopper 4. Gaskets 31, 41 are fitted on the valve collar 3 and the stopper to prevent leakage. The funnel 5 and the valve collar 3 are joined together by means of tenons 32 on the valve collar 3 and mortises 51 in the funnel 5.

Figure 4:
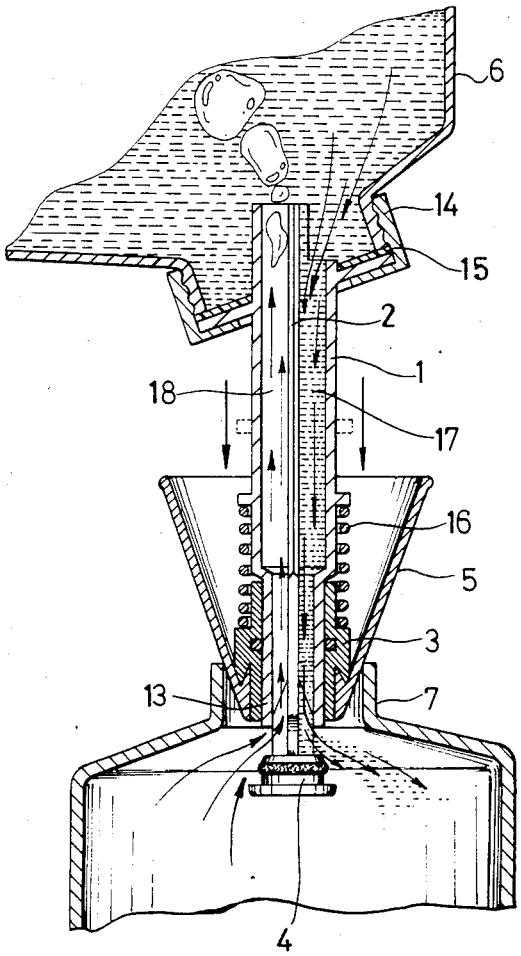
FIG. 4 illustrates the application of the said device.

As shown in FIG. 4, to use the device, the screwed cap 14 which can be made in different sizes is screwed on the container 6 in which the liquid is to be poured out. With the gasket 15, the joint is watertight without fear of leakage. Then the funnel 5 is inserted in the opening of the empty container 7 into which the liquid is to be poured. With the weight of the liquid container 6 and a little force applied on the container 6, the conduit 1, partition plate 2 and the stopper 4 as a whole will be slid down in the valve collar 3 which is placed in the opening of the container and kept from moving downward thereby. With the stopper 4 moving away from the valve collar 3, the opening between the small part 13 of the conduit 1 and the stopper 4 becomes open and the liquid in the container 6 flows quickly through the short channel 17 of the conduit 1, and the opening between the small part 13 and the stopper 4, into the empty container 7. At this time, commensurate air flows from the empty container 7 through the long channel 18 into the container 6. The convection prompts the flow of liquid and stops when the empty container 7 is filled with liquid. As soon as the force applied on the container 6 disappears, the conduit 1, the partition plate 2 and stopper 4 as a whole is pushed up by the tension spring 16 and the opening between the small part 13 and the stopper is closed by the valve collar 3. The flow of liquid is stopped immediately.

I claim:

1. A liquid pouring device comprising:

a conduit with a small part, a top end, and a flange, a spring fitted over the conduit and bearing against the flange, a screwed cap fixed to the top end of the conduit, a gasket fitted in the screwed cap, and retaining grooves in the inside of the conduit;

a partition plate having a cruciate part and a connection, said cruciate part having a lower end;

a valve collar having tenons;

a stopper having a gasket, a riveting hole, and a cup head rivet riveted within the hole;

a funnel having mortises;

and a container connected with said screwed cap;

said device being arranged in such a way that said partition plate is inserted in the retaining grooves and divides the conduit into one long channel and one short channel, said stopper is fixed to the lower end of the cruciate part of the partition plate, said tension spring is fitted over the conduit between the flange and valve collar and said tenons of said valve collar are joined with the mortises of the funnel, for pouring liquid from the container connected with the screwed cap into an empty container of different calibers.

* * * * *